US006331022B1

(12) United States Patent
Liroff

(10) Patent No.: US 6,331,022 B1
(45) **Date of Patent: *Dec. 18, 2001**

(54) CARGO SEAL

(76) Inventor: Jeff Liroff, 321 Sunset Dr., Apt 1, Ft. Lauderdale, FL (US) 33301

( * ) Notice: Subject to any disclaimer, the term of this patent is extended or adjusted under 35 U.S.C. 154(b) by 0 days.

This patent is subject to a terminal disclaimer.

(21) Appl. No.: 09/649,739

(22) Filed: Aug. 28, 2000

Related U.S. Application Data

(63) Continuation of application No. 09/188,483, filed on Nov. 9, 1998, now Pat. No. 6,113,163, which is a continuation-in-part of application No. 08/801,843, filed on Feb. 18, 1997, now Pat. No. 5,857,721.

(51) Int. Cl.[7] ..... B65D 27/30; E05B 65/06

(52) U.S. Cl. ..... 292/307 R; 292/321; 292/DIG. 32

(58) Field of Search ..... 292/307 R, 317, 292/318, 319, 320, 321, 323, 324, DIG. 32

(56) References Cited

U.S. PATENT DOCUMENTS

| | | | | |
|---|---|---|---|---|
| 446,653 | * | 2/1891 | Wheeler | 292/321 |
| 2,745,362 | * | 5/1956 | Lunde | 105/377.07 |
| 4,299,417 | * | 11/1981 | McClure | 292/320 |
| 4,389,862 | * | 6/1983 | Hastings | 292/DIG. 32 |
| 4,564,230 | * | 1/1986 | Haist | 292/DIG. 32 |
| 5,388,435 | * | 2/1995 | Bailey | 292/100 X |
| 5,857,721 | * | 1/1999 | Liroff | 292/307 R |
| 6,113,163 | * | 9/2000 | Liroff | 292/307 R |

* cited by examiner

*Primary Examiner*—Robert G. Santos
(74) *Attorney, Agent, or Firm*—Malloy & Malloy, P.A.

(57) ABSTRACT

An improved cargo seal structured to securely close a container having at least one door, the cargo seal including a lock assembly, having at least one lock aperture defined therein and being structured to secure the door in a closed orientation, and an elongate segment of substantially strong, generally flexible material. The elongate segment is structured to extend through the lock aperture of the lock assembly so as to restrict movement and/or actuation of the lock assembly. A pair of lock segments are further provided and are correspondingly disposed at a first end and a second end of the elongate segment, at least one of the lock segments being structured to be securely coupled with at least one mating segment at one end of the elongate segment. Each of the lock segments has an increased diameter relative to a diameter of the elongate segment so as to prevent removal of the elongate segment from the lock aperture by passage over the ends of the elongate segment. Moreover, each of the lock segments further includes an identifying indicia disposed thereon so as to prevent its unauthorized replacement.

17 Claims, 3 Drawing Sheets

CARGO SEAL

CLAIM OF PRIORITY

The present application is a Continuation application having Ser. No. 09/188,483 which was filed on Nov. 9, 1998, now U.S. Pat. No. 6,113,163, which is a Continuation-In-Part of U.S. patent application having Ser. No. 08/801,843 filed Feb. 18, 1997, also incorporated herein by reference, which matured into U.S. Pat. No. 5,857,721 on Jan. 12, 1999.

BACKGROUND OF THE INVENTION

1. Field of the Invention

The present invention is directed towards an improved cargo seal which is structured to be utilized on a cargo container in order to maintain the cargo container's doors securely locked in a closed orientation, and which is further structured such that the door cannot be opened without destructively removing the primary cargo seal which corresponds and identifies the shipment and/or without providing clear evidence of tampering upon inspection of the primary cargo seal, thereby substantially protecting the contents of the cargo container, while also substantially identifying when tampering has occurred.

2. Description of the Related Art

Large, cargo containers, such as those that are detachable or are formed as part of trailers are the most commonly used means of transporting large volumes of many varying cargos from location to location around the world. A primary advantage to their use is that the large containers can store large quantities of goods and can be effectively transported on boats, trains, and/or trucks in order to expeditiously arrive at their eventual destination. The detachability and adaptability of containers is of particular importance because the containers will often change hands from one carrier to another carrier, such as from a train to a truck or from a trucking company to a steamship line, during the various legs of a transport route.

Naturally, due to the great volume and often valuable nature of the cargos being transported in the large containers, security is an important consideration when dealing with cargo transportation. Unfortunately, however, one of the most prevalent security concerns, in addition to the third party hijackers or thieves who do not generally care if they leave signs of a break in, involves internal, not obviously detectable theft. For example, it is sometimes an all too common occurrence that during transit, an individual placed in custody of the container, such as a truck driver in charge of transporting the cargo from point to point, is behind a robbery. Such an individual is naturally very familiar with the nature of the cargo on board, and can easily arrange for a safe rendezvous for the removal of all or part of the cargo contained within the large container. Unlikely as it may seem, in these instances, it is often the security measures and/or locks which are normally employed that serve as the biggest allies to the thieves.

A conventional, single-use, single end seal is the common article used to secure the door handle/latch in a door closing orientation. Moreover, this is the primary seal, and more likely the only seal that is looked at by shipping personnel assigned to verify the integrity of a shipment during transit. Unfortunately, thieves have still found ways to unlatch the doors without actually breaking the seal. Specifically, the joint between the actuation handle and the lock rod on most conventional containers generally incorporates a single bolt or rivet securing both elements with one another. As a result, a thief can merely cut or drill out and remove that bolt or rivet to permit the independent turning of the lock rod while the actuation handle remains in place, thereby opening the container without having to move the actuation handle or break the seal. Once the cargo has been removed and the door is re-closed, a replacement bolt is merely inserted to connect the actuation handle with the lock rod, and can be painted over if necessary to preserve the original appearance. As a result, the conventional type identifying seal has never been removed and no evidence of tampering is available as the cargo changes hands from one carrier to another. Accordingly, when the specific carrier involved in the theft arrives at a next leg of the transport, the container looks normal and intact, and the responsibility is passed on to the next transport carrier. Naturally, when the theft is ultimately discovered, blame passes from carrier to carrier with no concrete resolution as to the true thieves or the actual stage of transport during which the theft occurred. Moreover, as no positive blame can be put on any particular carrier, it is often the owner of the cargo who must take the loss and must fight their insurance company for some recovery.

Despite the numerous techniques thieves have found to defeat existing systems, and because of the high volume of cargo being transported on a daily basis, and the cost of more extensive security measures, most carriers still utilize the above-described securing methods to seal the cargo doors. Such carriers accept a certain percentage of losses to theft as an expense of doing business given the lack of a viable alternative. Accordingly, it would be highly beneficial to provide a cargo container seal and door lock which can defeat or at least significantly hinder the "inside job" theft in a cost effective and easy to implement fashion. Such an improved seal should be structured so as to resist opening of the doors without its removal, and should be difficult to replace without providing substantially clear and noticeable evidence of tampering, thereby allowing the identification of a theft by a transport company when they take on the cargo.

For these reasons, some carriers have turned to utilizing single use locking brackets which employ common single use, single end seals which bear a particular, recorded serial number thereon, if added security is desired. Accordingly, when the cargo container changes hands from one carrier to another both the bracket seal and the primary seal are supposed to be inspected and the numerals on the both seals are recorded to ensure that they match the shipping records. Still, however, while such techniques are more effective than the security measures which had previously been available, clever thieves have quickly found ways around those procedures as well. Specifically, because a thief that performs such an "inside job" is typically associated with the normal shipping procedures, they are typically aware that in most circumstances, transfer of custody between shippers is only accompanied by an inspection of the primary cargo seal at the door latch, and a comparison of its identification number with the one depicted on the shipping manifest. Indeed, a numbered seal is often not used with a door bracket structure, and in any event, the identification number on the bracket seal is rarely recorded, let alone inspected. Accordingly, a thief is typically able to merely cut off the bracket, removing it completely from the container and discarding the bracket seal. In particular, because a subsequent shipping agent is not aware of the condition in which a prior shipping agent received a cargo container, unless something is clearly reflected on the manifest, the lack of the bracket is not usually recognized. This is especially the case if the primary cargo seal identification number is correct as a vast majority of shipments still arrive without any secondary sealing.

As such, it would be beneficial to provide an improved cargo seal that is structured to require the actual removal or tampering with the primary cargo seal in order to access the container. Such a seal, which prior to the present invention has not been provided, should be structured to be permanently and noticeably damaged or tampered with if the container is accessed, and should be difficult to duplicate easily and effectively. Accordingly, even a cursory review by a shipping agent of the primary seal serial number will necessarily reveal that tampering has occurred.

SUMMARY OF THE INVENTION

The present invention is directed towards an improved cargo seal to be utilized to securely close a container having at least one door. Specifically, the cargo seal includes a lock assembly structured to secure the door in a closed orientation and including at least one lock aperture. The lock aperture is disposed preferably to extend through mating portions of the lock assembly which must be moved relative to one another in order to permit movement of the door into an open orientation.

Moreover, the improved cargo seal includes an elongate segment formed of a substantially strong, generally flexible material. The elongate segment is structured to extend through the lock aperture of the lock assembly in order to restrict relative movement of the lock assembly into the orientation that will permit opening of the doors, while it extends through the aperture.

At least one end of the elongate segment includes a mating segment. Further, a pair of lock segments are provided, the lock segments being structured to be correspondingly disposed at the opposite ends of the elongate segment. At least one of the lock segments, however, is structured to be securely, and substantially fixedly coupled with the mating segment at one end of the elongate segment such that separation therebetween cannot be achieved without physically damaging the lock segment or the elongate segment. As such, the lock segment and mating segment can be secured with one another after the elongate segment is passed through the lock aperture, but cannot be readily removed once engaged. Additionally, each of the lock segments includes an increased diameter relative to a diameter of the elongate segment and the lock aperture. As such, the lock segments prevent removal of the elongate segment from the lock aperture by passage over the ends of the elongate segment, but rather require physical removal of one of the lock segments, such as by severing the elongate segment, or require damage of the lock assembly itself. In either instance, physical damage must be caused if the lock assembly is to be released for movement into a released orientation, and tampering is therefore clearly noticeable as the primary cargo seal to be associated with the shipping manifest must necessarily be removed.

It is an object of the present invention to provide an improved cargo seal structured to be secured to a cargo container door in such a manner as to prevent opening of the cargo container doors without its actual removal.

Yet another object of the present invention is to provide an improved cargo seal which includes a tamper evident cargo container door lock which physically prevents opening of the container door in addition to normal locking achieved by a closure latch assembly.

A further object of the present invention is to provide an improved cargo seal having independent identifying indicia disposed thereon in order to increase the difficulty associated with unnoticeably replacing a removed cargo seal.

Still an object of the present invention is to provide a cargo seal which cannot be removed without noticeably breaking the seal, and whose removal is required in order to open the cargo container doors.

Another object of the present invention is to provide an improved cargo seal which integrates structure utilized to physically maintain the container doors closed with the identified primary cargo seal placement location in a manner that requires physically noticeable tampering and/or removal of the seal from the primary cargo seal location in order to effectuate opening of the container doors.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
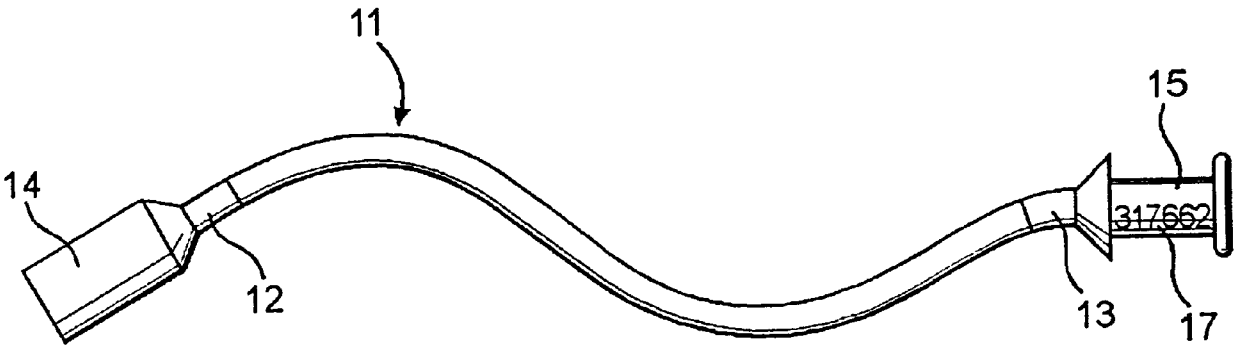
FIG. 1 is a perspective view of the elongate segment and lock segments of the improved cargo seal of the present invention.
Figure 2:
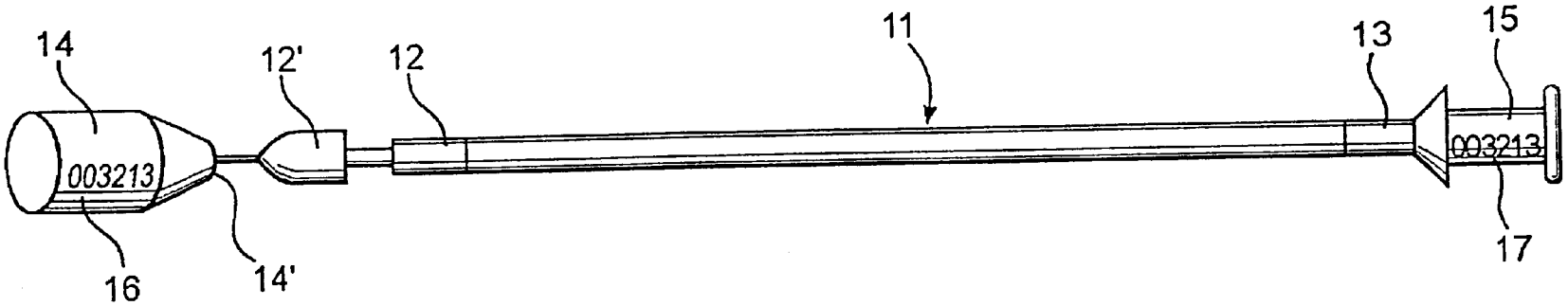
FIG. 2 is an exploded view of the elongate segment and lock segments of the improved cargo seal of the present invention.

The present invention is directed towards an improved cargo seal, generally indicated as 10. Specifically, the cargo seal 10 is structured for use on a cargo container 80 of the type that includes at least one, but typically a pair of doors 81 and 81' secured in a closed orientation. The doors 81 and 81' are secured in the closed orientation by a lock assembly of the present invention which is structured, as part of the improved cargo seal 10 of the present invention, to provide security against unauthorized opening of the doors 81 and 81' and clear evidence of tampering should a break-in be attempted and/or achieved. As such, an individual transport carrier will be able to effectively and routinely inspect the cargo container 80 before accepting custody and can more readily identify a prior break in. The cargo container 80 itself can either be of a detachable kind or can be included as part of a trailer.

In particular, the improved cargo seal 10 of the present invention includes an elongate segment 11 preferably formed of a substantially strong, yet flexible material. In the preferred embodiment, the elongate segment 11 is formed of braided or bound metal strands which are generally secured together at opposite ends thereof to form a very strong durable cable type segment. Moreover, as a plurality of individual strands are preferably utilized to make up the preferred elongate segment 11, some flexibility is achieved and if the elongate segment 11 is cut, the quantity of strands are such that the elongate segment 11 cannot be unnoticeably returned to its original form, such as by welding. Furthermore, the elongate segment 11 is preferably of a sufficient thickness such that it will be substantially difficult to quickly and easily cut.

The elongate segment 11 includes a first end 12 and a second end 13 which are preferably spaced apart from one another. For example, although not preferred, it may be desirable for the elongate segment 11 to extend across the adjacent doors 81 and 81' of the cargo container 80, into engagement with lock assemblies associated with each door. Nevertheless, in the preferred embodiment of the present invention, the elongate segment 11 is one or two feet long so as to achieve the preferred interconnection with the lock assembly to be described in greater detail subsequently. Of course, the ultimate actual length and make up of the elongate segment 11 may vary depending upon the actual scale of the container and the spaced apart nature of the various components through which the elongate segment 11 is to extend.

In the preferred embodiment, at least one end, such as a first end 12 of the elongate segment 11, includes a mating segment 12'. Of course, in an alternative, less preferred embodiment, both the first end 12 and the second end 13 of the elongate segment 11 may include a mating segments. Furthermore, the present invention includes at least one, but in the illustrated embodiment a pair of lock segments 14 and 15. In particular, if desired, a single lock segment may be provided, both the first and second ends 12 and 13 of the elongate segment 11 extending into engaging relation therewith such that the single lock segment is essentially equivalent to a pair of lock segments in a unitary piece. At least the lock segments 14 is structured to receive the corresponding mating segment 12' securely and fixedly disposed therein. Specifically, in the illustrated embodiment it is preferred that the second lock segment 15, or in an alternate embodiment a portion of the single lock segment, be previously secured at an end of the elongate segment 11, such that subsequent to positioning of the elongate segment 11 only a single mating segment 12' need be introduced into a lock segment 14, with regard to preferred embodiment, however, it is understood that the pre-securement can comprise an integral construction, as illustrated, or can comprise a previously joined mating segment and lock segment.

Looking in greater detail to the coupled engagement between the elongate segment 11 and the pair of lock segment 14 and 15, the mating segments 12' is generally structured to be correspondingly introduced into an axial aperture 14' of the lock segment 14. Because a diameter of the mating segment 12' is slightly larger than a diameter of the axial aperture 14' of the lock segment 14, and possibly because of further one way locking structure in the lock segment 14, some force is required to introduce the mating segment 12'. Once introduced, however, removal of the mating segment 121 is not possible, unless the structure is physically damaged, such as by cutting the lock segment or drilling out the mating segment from the lock segment 14, procedures which are not only difficult, but which are very noticeable if the lock segment is replaced to try to cover up tampering. In this regard, in the preferred embodiment the mating segment 12' defines a male lock portion with the lock segment 14 defining a female lock portion. Of course, an alternative male/female configuration could be incorporated if necessary, so long as a secure, fixed, interconnection therebetween is achieved. Preferably, however, the lock segments 14 and 15 include an increased diameter relative to the elongate segment 11, and as such, it is more practical for the lock segment 14 to define a female lock portion.

Included on at least one and possibly each of the lock segments 14 and 15, is preferably an identifying indicia 16 and 17. Specifically, the identifying indicia 16 and 17 is preferably inscribed on the lock segment(s) 14 and 15 in such a manner as it cannot be conveniently duplicated on site. Moreover, the identifying indicia on at least one of the lock segments 15 defines the identification number of the primary cargo seal used on the container 80 and is thereby recorded on the shipping manifest as the number to be verified at a transfer point.

The improved cargo seal 10 of the present invention further includes a lock assembly. Specifically, the lock assembly is structured to secure the doors 81 and 81' of the cargo container in the closed orientation, and includes a lock aperture 25 defined therein and through which the elongate segment 11 extends, as will be described in detail subsequently, so as to seal the container 80 in its closed orientation. In the preferred embodiment of the present invention, the lock assembly preferably includes, as preferably only a first component thereof, a door closure latch assembly, generally 20. The closure latch assembly 20 is preferably of the type that is normally included on a cargo container 80, and preferably includes a lock rod 84 disposed to extend down the door 81 of the container. Of course, in an embodiment with two doors 81 and 81', a lock rod 84 and 84' may be provided on each door 81 and 81', as part of a single or a pair of closure latch assemblies, so as to maintain the doors 81 and 81' secured in the closed orientation.

Connected with the lock rod 84 as part of the closure latch assembly 20 is an actuation handle 22 which permits appropriate maneuvering of the lock rod 84 to latch and un-latch the door 81, thereby achieving locking and releasing orientations. Specifically, in the preferred multi-door embodiment of the container 80, a first one of the doors 81 is generally the main door which holds the other, second door 81' closed until it is moved. Accordingly securement of the main door 81 is normally sufficient to keep both doors 81 and 81' closed. The actuation handle 22 of that main door 81 generally rests within a bracket where it can be locked or sealed in place. Typically, the bracket, which holds the actuation handle 22 in its door closing orientation so that the lock rod 84 maintains the door 81 latched, includes a lock flange 24 which is secured to the door 81 and extends down onto the actuation handle 22. The lock flange 24 and actuation handle 22 include the preferred embodiment of the lock aperture 25 of the lock assembly defined therein. The lock aperture 25 is structured and disposed to receive the elongate segment 11 therethrough to secure the actuation handle 22 in the bracket and in its generally flat engagement along the door 81 which maintains the lock rod 84 in a door latching orientation. Specifically, the actuation handle 22 is generally connected to the lock rod 84 at a connection joint disposed therebetween. Accordingly, with the actuation handle 22 secured to the lock rod 84 at the connection joint, upon pulled movement of the actuation handle 22 away from the door 81 and into a generally perpendicular orientation, the lock rod 84 will also rotate and can be moved to unlatch the door 81 from its closed orientation. By introducing the elongate segment 11 through the lock aperture 25, movement of the handle 22 away from the lock flange 24 and accordingly the door 81 is prevented without removal of the elongate segment 11. Moreover, as the elongate segment 11 is of an extended length, it may be introduced through the corresponding lock apertures of the second closure assembly on the second door 81', if applicable. In either instance, the lock segments on the elongate segment 11 include the identifying indicia of the primary seal that secures the container closure latch assembly 20 closed, and opening of the closure latch assembly 20 requires affirmative removal or tampering with the elongate segment 11 or lock segments 14 and 15.

Turning to the embodiments of the present invention illustrated in FIGS. 3–6, the lock assembly of the improved cargo seal 10 of the present invention also includes instead of or preferably in addition to the door closure latch assembly 20, a tamper evident cargo container door lock 30. The tamper evident container door lock 30 may include a variety of configurations, but is preferably structured to be secured to the container 80, such as to the lock rod 84, so as to provide a further element that must be tampered with or overcome in order to remove the elongate segment 11 completely without leaving a trace of tampering. For example, existing single use seals can be completely removed from the door latch assembly and replaced with a new single use seal, however, the structure of the present invention which further provides that the same seal, namely the elongate segment 11, secures both the closure latch assembly 20 and a secondary tamper evident container door lock 30 in the manner to be described subsequently, requires a thief to break through both the elongate segment 11 and the tamper evident door lock 30 to remove all components of the improved cargo seal 10 of the present invention and remove traces of tampering. Of course, if desired, a separate more conventional seal can also be used with the container door lock 30, the elongate segment 11 providing an additional security measure to hinder complete detachment of all of the container door lock 30 from the container.

Figure 3:
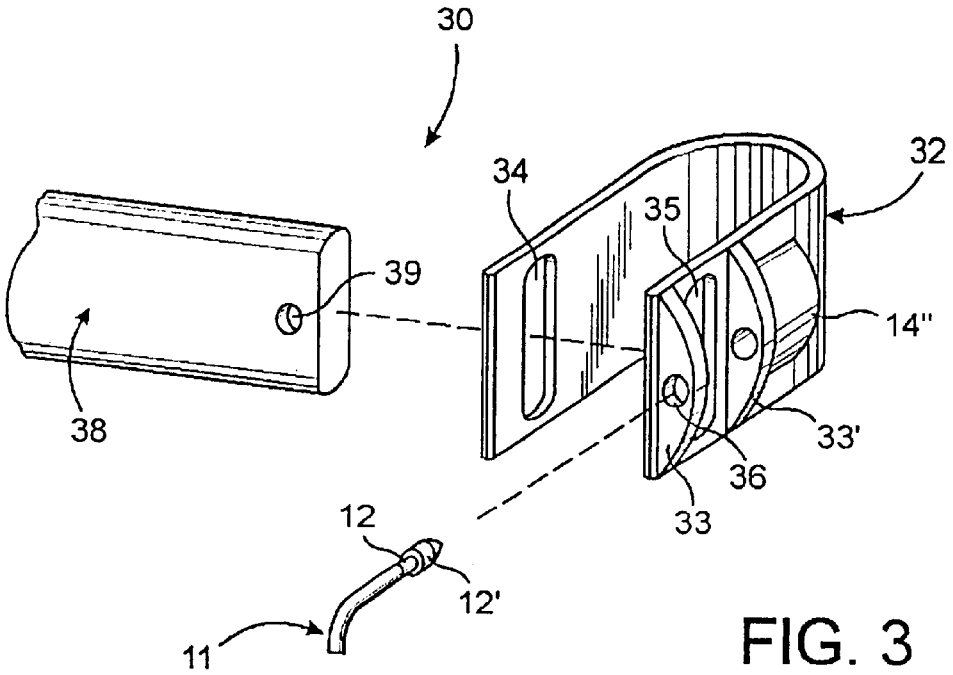
FIG. 3 is a partial, exploded view of a preferred embodiment of the improved cargo seal of the present invention.
Figure 4:
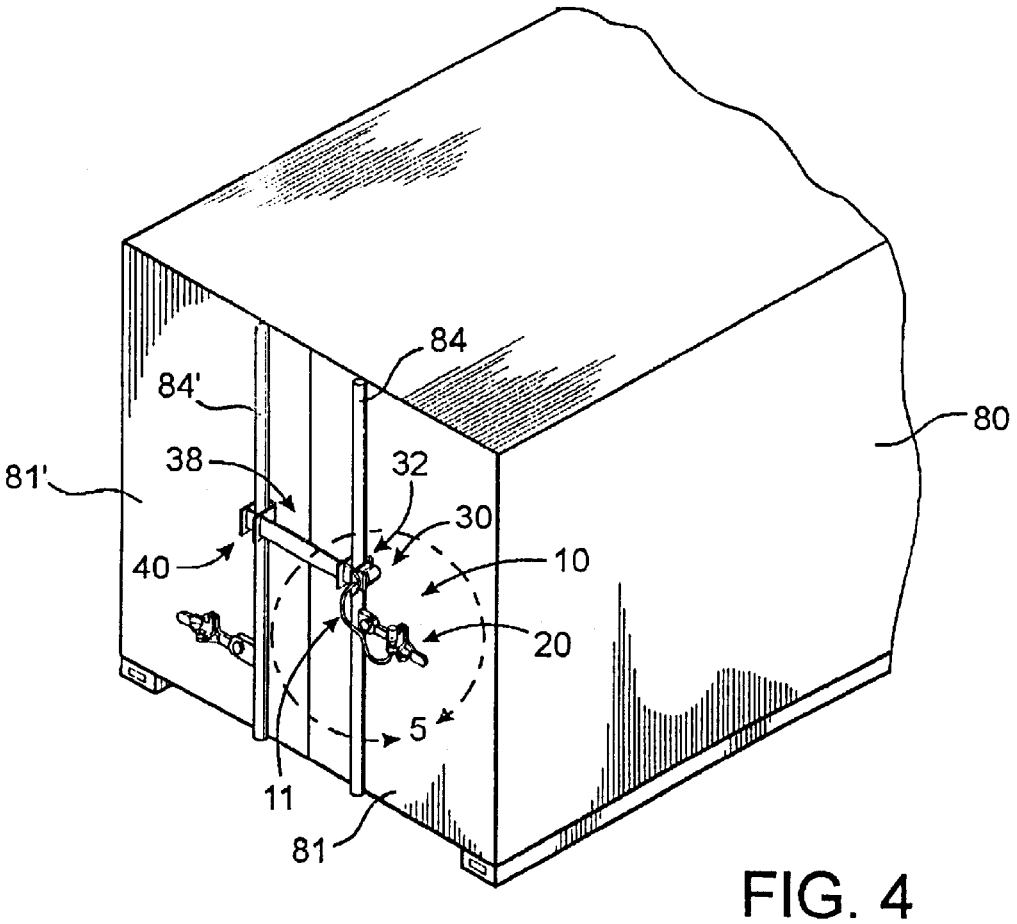
FIG. 4 is a perspective view of a rear door of a cargo container including a preferred embodiment of the improved cargo seal of the present invention disposed thereon.
Figure 5:
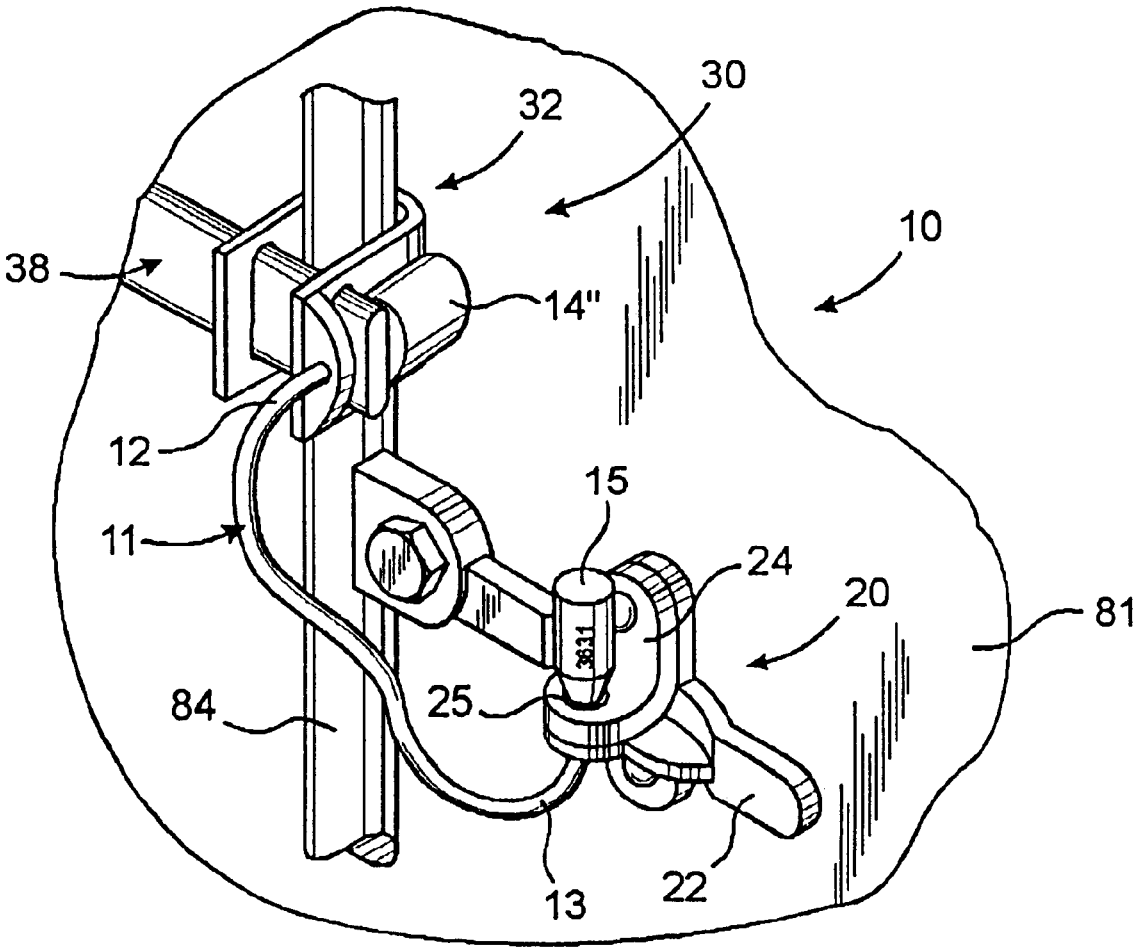
FIG. 5 is an isolated, closeup view of area 5 in FIG. 4, illustrating a preferred embodiment of the improved cargo seal of the present invention.

In the preferred embodiment, the tamper evident container door lock 30 includes a generally C-shaped retention bracket 32 formed of a strong, durable material. The retention bracket 32 is structured to be disposed about the lock rod 84 so as to generally retain the lock rod 84 therein. Moreover, the tamper evident door lock 30 further includes a cross brace 38 structured and disposed to generally engage and secure the retention bracket 32 about the lock rod 84. As a result, although the retention bracket 32 may slide vertically along the lock rod 84, it cannot be laterally removed from the lock rod 84. Indeed, the lock rod 84 generally is secured at opposite ends thereof to the door 81 such that sliding of the retention bracket 32 over either end of the lock rod 84 is also prevented. Also, the positioning of the elongate segment 11 as will be described also prevents sliding movement over the lock rod 84 to an extent that would permit removal of the retention bracket 32 from an end of the lock rod 84. Additionally, although not illustrated for clarity, it is also noted that the engaged relation between the retention bracket 32 and the cross brace 38 maybe so as to enclose the an open area of the retention bracket as in the illustrated embodiment, or may be so as to merely restrict the lateral movement of the retention bracket 32 so that the lock rod cannot slide out from the interior of the retention bracket. Of course, in that alternate embodiment, it is preferred that the cross brace also be secured to a fixed position, such as the other lock rod as will be described, so as to prevent lateral movement of the overall assembly to remove the retention bracket 32 from the lock rod. As best seen in FIG. 3, in the illustrated embodiment the cross brace 38 generally extends through the retention bracket 32, such as through a pair of spaced apart openings 34 and 35, so as to achieve its enclosing engagement with the retention bracket 32.

The cross brace 38 also preferably includes one or more apertures 39 defined therein. In the illustrated embodiment, the elongate segment 11 is structured to extend through the aperture 39 of the cross brace 38 and thereby prevent removal of the cross brace 38 from the container. Specifically, the aperture 39 of the cross brace 38 is preferably sized to a lesser diameter than the lock segments such that once the elongate segment 11 is threaded through the aperture 39 of the cross brace 38, it cannot be pulled back through. Further, in the illustrated embodiment, the openings 34 and 35 are preferably only of a sufficient dimension to allow passage of the cross brace 38, and as such, the cross brace 38 with the elongate segment 11 extending therethrough cannot be pulled back out through the openings 34 and 35.

Once the cross brace 38 is disposed in engaging relation with the retention bracket 32, a seal assembly may be used to secure them with one another and thereby maintain the retention bracket 32 secured to the lock rod. Although a conventional seal may define the seal assembly to prevent the cross brace 38 being separated from the retention bracket 32, the elongate segment 11 may act as all or part of the seal assembly, and in the illustrated embodiment, one of the lock segments 14" is preferably included as part of the tamper evident door lock 30 and is secured with the retention bracket 32. In particular, as shown in the figures, the lock segment 14" is preferably fixedly secured to the retention bracket 32 preferably at generally a point where the cross brace 38 emerges through the retention bracket 32. As such, the cross brace 38 cannot be pushed further through the retention bracket 32 once the elongate segment 11 secures the elements to one another. Further, the lock segment 14" is preferably disposed in sufficiently close proximity to the cross brace 38 when it emerges from the opening 35 as to make it substantially difficult to cut the elongate segment 11 at a point between the lock segment 14" and the cross brace 38, thereby making it substantially difficult to remove the cross brace 38 merely by cutting the elongate segment 11, as a portion of the strong elongate segment 11 adjacent the lock segment 14" will still be disposed in the aperture 39 of the cross brace 38 so as to prevent relative movement therebetween. To this end, a pair of hub sections 33 and 33' including an access port 36 are preferably disposed on opposite sides of the opening 35 so as to generally sandwich the cross brace 38 therebetween and further prevent cutting access to that portion of the elongate segment 11 that extends therethrough and through the cross brace 38. From the preceding, it can be seen that even if the elongate segment 11 is cut and removed to permit opening of the closure latch assembly 20, the tamper evident door lock 30 must itself be damaged or cut in order to physically remove it from the container 80.

Looking further to the preferred embodiment of the Figures, the tamper evident door lock 30 and preferably the cross brace 38 are also preferably structured to prevent opening of the door 81 of the container 80. In particular, the cross brace 38 is preferably sufficiently elongate so as to extend across the seam between the adjacent doors 81 and 81' so as to physically restrict outward opening of the doors 81 and 81'. Furthermore, a second generally C-shaped retention bracket 40 may also preferably included and disposed about a second lock rod 84' on the second door 81'. As yet another embodiment, the retention bracket may be integrally formed with the cross brace, and need not necessarily enclose the second lock rod 84'. For example the second retention bracket may engage the second lock rod in such a manner as to restrict movement of the container door lock 30 in a direction that would lead to removal of the first lock rod from the first retention bracket, and visa versa, unless the cross brace is disengaged from the first retention bracket.

With the second retention bracket 40 in place, the cross brace 38 preferably secures it to the second lock rod 84' before extending on to the first retention bracket 32 in order to secure it in place. As such, if an attempt is made to pull open the doors 81 and 81', the cross brace 38 prevents opening of the doors unless it is physically removed. This embodiment is particularly beneficial because thieves in some instances will detach the actuation handle 22 of the closure latch assembly 20 from the lock rod 84 so as to achieve rotation of the lock rod 84 without requiring movement of the actuation handle 22 and accordingly removal of the seal from the lock aperture 25 in the actuation handle 22. With the cargo seal 10 of the present invention, such techniques would be insufficient and a thief would still be required to remove the cross brace 38. Further, even if the cross brace 38 is cut, the retention bracket 32 will remain secured about the lock rod 84 providing glaring evidence of tampering and thus requiring its removal as well by an "inside job" thief that does not wish to leave a trace of tampering when the container 80 is passed off to the next shipping agent. As previously recited, however, removal of the retention bracket 32 requires physical damaging of the retention bracket 32. Even more importantly, however, because it is the same elongate segment 11 that secures both the closure latch assembly 20 and the tamper evident door lock 30 in place, removal of the tamper evident door lock 30 from the lock rods of the container 80 in order to open the doors would still leave a damaged portion of the tamper evident door lock 30 connected to the elongate segment 11, thereby requiring removal of the elongate segment 11 therefrom. Of course, the only way to remove the elongate segment 11 from the tamper evident door lock is to damage the lock segment 14" in a visible manner or to cut the elongate segment 11. Cutting of the elongate segment 11, however, results in its falling out from the closure latch assembly 20 and removal of the lock segment 15 containing the primary identification indicia. Accordingly, the structure of the cargo seal 10 of the present invention thereby ensures that a new carrier must merely match the single, primary identification indicia, a common and accepted procedure, and look for glaringly suspicious and damaged components still connected to the container 80, in order to identify tampering. In further support of this security, the present invention also contemplates the inclusion of a label or sticker depicting the normal appearance of the improved cargo seal 10 of the present invention adhered to the shipping manifest and containing the primary identification number that must be verified before a cargo changes hands, thereby minimizing the risk that the improved cargo seal 10 of the present invention was somehow replaced with a new simple seal with the same identification number.

From the preceding structure, it can be seen that in order to implement the improved cargo seal 10 of the present invention, the doors 81 and 81' are closed, the latch closure assembly 20 is put in a door closing orientation, the retention brackets 32 and 40 are disposed about the lock rods 84 and 84', the cross brace 28 is slid through both of the retention brackets 32 and 40, the elongate segment 11 is passed through the lock aperture 25 and the aperture 39 of the cross brace 38, and at least one mating segment 12' is introduced into at least one lock segment 14. In this regard, and as previously recited, although not required, the lock segment 15 is preferably pre-secured, a free end 12 of the elongate segment 11 being threaded through the lock aperture 25 and through the aperture 39 in the cross brace 38 for securement with the other lock segment 14, or 14".

Since many modifications, variations and changes in detail can be made to the described preferred embodiment of the invention, it is intended that all matters in the foregoing description and shown in the accompanying drawings be interpreted as illustrative and not in a limiting sense. For example, the tamper evident door lock 30 may also equivalently include the structure of the tamper evident door lock of U.S. Pat. No. 5,791,702. Thus, the scope of the invention should be determined by the appended claims and their legal equivalents.

Now that the invention has been described,

What is claimed is:

1. To securely close a container having at least one door, an improved cargo seal comprising:

a lock assembly, said lock assembly being structured to secure the door in a closed orientation and including at least one lock aperture;

an elongate segment of substantially strong, generally flexible material, said elongate segment including opposite ends and structured to extend through said lock aperture of said lock assembly so as to restrict movement of said lock assembly and accordingly release of the door from said closed orientation;

at least one of said opposite ends of said elongate segment including a mating segment;

a lock segment structured to be correspondingly and substantially fixedly disposed at said opposite ends of said elongate segment so as to generally prevent removal thereof segment and thereby providing visible evidence of tampering;

said mating segment structured to be securely coupled with said lock segment, said lock segment having an increased diameter relative to a diameter of said elongate segment, so as to prevent removal of said elongate segment from said lock aperture, and accordingly movement of said lock assembly to permit opening of the door, without removal of said lock segment or visibly damaging said lock assembly, thereby providing clear evidence of tampering and opening of said door, said lock assembly including at least a cargo door latch assembly in which said lock aperture is defined, and a tamper evident container door lock, said cargo door latch assembly including a lock rod disposed on the door of the container, said tamper evident door lock including a retention bracket structured to be disposed about said lock rod, and a cross brace structured to be secured with said retention bracket;

said cross brace structured to generally retain said retention bracket engaged with said lock rod so as to prevent removal of said retention bracket from said lock rod; and said elongate segment structured to extend through at least said cross brace.

2. An improved cargo seal as recited in claim 1 wherein said lock segment includes an identifying indicia disposed thereon so as to verify that said elongate segment and said lock segment originally secured through said lock aperture have not been replaced with new ones of said elongate segment and said lock segment after unauthorized access to the container.

3. An improved cargo seal as recited in claim 2 including a pair of said lock segments, each of said lock segments includes identifying indicia disposed thereon.

4. An improved cargo seal as recited in claim 1 including a pair of said lock segments disposed at said opposite ends of said elongate segment.

5. An improved cargo seal as recited in claim 1 wherein said lock segment includes a single lock segment secured to both of said opposite ends of said elongate segment.

6. An improved cargo seal as recited in claim 1 wherein said tamper evident door lock is secured to the container by said fixed disposement of said lock segment with a corresponding end of said elongate segment, thereby requiring physical damaging of said tamper evident door lock, said elongate segment or said lock segment in order to permit removal thereof from the container.

7. An improved cargo seal as recited in claim 1 including a seal assembly structured to secure said cross brace to said retention bracket.

8. An improved cargo seal as recited in claim 7 wherein seal assembly is at least partially defined by said lock segment.

9. An improved cargo seal as recited in claim 7 wherein seal assembly is at least partially defined by said elongate segment.

10. An improved cargo seal as recited in claim 1 wherein said retention bracket includes a pair of spaced apart openings wherethrough said cross brace extends so as to enclose said retention bracket.

11. An improved cargo seal as recited in claim 1 wherein said cross brace includes an aperture defined therein, said elongate segment further structured to extend through said aperture in said cross brace so as to prevent removal thereof from said retention bracket.

12. An improved cargo seal as recited in claim 11 wherein said retention bracket includes said lock segment secured therewith and disposed such that said elongate segment extends through said aperture in said cross brace when said cross brace is disposed in said enclosing engagement with said retention bracket and into secure engagement therewith, thereby preventing slided removal of said cross brace from said retention bracket.

13. An improved cargo seal as recited in claim 12 wherein said lock segment is fixedly secured to said retention bracket and is disposed relative to said cross brace so as to prevent facilitated severing of said elongate segment at a point which permits slided removal of said cross brace from said retention segment, thereby requiring visible damaging of at least two components of the cargo seal to effectuate complete removal thereof.

14. An improved cargo seal as recited in claim 12 wherein said cross brace is generally elongate and is structured to restrict opening of the door of the container when in said enclosing engagement with said retention bracket.

15. An improved cargo seal as recited in claim 14 wherein said tamper evident door lock includes a second generally C-shaped retention bracket disposed about a lock rod on a second door of the container and structured to receive said cross brace therethrough in enclosing engagement therewith so as to prevent normal opening of the doors of the container without removal of said cross brace and removal of said elongate segment from said lock aperture, thereby providing visible evidence of tampering.

16. An improved cargo seal as recited in claim 1 further comprising a depiction of the improved cargo seal properly positioned on a container, said depiction being secured to a shipping manifest associated with a cargo in the container.

17. An improved cargo seal as recited in claim 16 wherein said depiction further includes an identifying indicia visibly disposed thereon, and at least one of said lock segments includes said identifying indicia disposed thereon so as to verify that said elongate segment and said lock segment originally secured through said lock aperture have not been replaced with new ones of said elongate segment and said lock segment after unauthorized access to the container.

* * * * *